US005230127A

United States Patent [19]

Zukowski et al.

[11] Patent Number: 5,230,127

[45] Date of Patent: Jul. 27, 1993

[54] PERSONALIZED FACE CREMATION URN

[75] Inventors: Raymond L. Zukowski; Randy S. Willis, both of Vista, Calif.

[73] Assignee: Rayzist Photomask, Inc., Vista, Calif.

[21] Appl. No.: 879,880

[22] Filed: May 7, 1992

[51] Int. Cl.[5] ..... A61G 17/00

[52] U.S. Cl. ..... 27/1; 720/327

[58] Field of Search ..... 27/1, 35, 2; 220/410, 220/327

[56] References Cited

U.S. PATENT DOCUMENTS

| | | | |
|---|---|---|---|
| 1,233,605 | 7/1917 | Ridley | 27/1 |
| 1,373,014 | 3/1921 | Moore | 27/1 |
| 2,009,724 | 7/1935 | Bircher | 27/1 |
| 3,167,844 | 2/1965 | Bachofner | 27/1 |
| 4,199,848 | 4/1980 | Kohnert | 27/1 |
| 4,648,162 | 3/1987 | Daino | 27/1 |

*Primary Examiner*—Richard E. Chilcot, Jr.
*Attorney, Agent, or Firm*—Nixon & Vanderhye P.C.

[57] ABSTRACT

A cremation urn has a front wall with human readable indicia (such as the name of a deceased human or pet) formed integrally with the front wall, the front wall actually being a component of the urn. The indicia may be relief indicia, as formed by sand blasting decorative stone such as granite or marble, or raised indicia, such as formed with a bronze casting. Side walls with grooves for receiving the front wall side edges, and edges of a common top, rear, and partial bottom piece of malleable material (e.g. brass), are held together with a number of bolts and cooperating T-nuts, with the bolt holes covered with plugs, or by hooks and turnbuckles. The bottom includes a removable plate, which allows access to the interior volume so that ashes in a bag may be readily inserted into, and removed from, the container.

20 Claims, 2 Drawing Sheets

PERSONALIZED FACE CREMATION URN

BACKGROUND AND SUMMARY OF THE INVENTION

Cremation urns, for holding the ashes of cremated humans and pets, always have some indicia on them indicating at least the name of the person or pet whose ashes are contained by the urn. Heretofore, this indicia has typically been provided on a plaque or label that is affixed to the urn, and it may contain other variable and personal information, such as the date of birth and death, a poem, a eulogy, etc. Heretofore there has been no practical way of having the personalized information, including name, as part of the urn itself.

Also, conventional cremation urns have had a limited number of styles, and have not made maximum use of the wide variety of aesthetic construction materials that are available, and usually have been almost completely of one material.

According to the present invention, a container particularly useful as a cremation urn, and a method of displaying ashes in a cremation urn, are provided that have a number of significant, practical advantages over the prior art. According to one aspect of the present invention, a cremation urn is provided which provides the personalized information (indicia) about the person whose ashes are contained within it as an integral part of a wall of the urn itself, e.g. in relief (such as sand blast into a piece of decorative stone such as granite or marble), or raised (such as cast as part of a bronze wall).

According to a second aspect of the invention, a container useful as a cremation urn is provided that is capable of using a wide variety of materials, and different types of material within a single urn (e.g. decorative stone, wood, and jewelry grade malleable metal together), with surface manifestations on portions of the container locating the other portions in place, in conjunction with removable connectors, such as bolts and T-nuts, or hooks and turnbuckles.

According to a third aspect of the invention, a method of displaying ashes is provided including constructing an urn with personalized variable human-readable indicia (including the name of a cremated human) formed as an integral part of the front wall of an urn containing the ashes.

According to the first aspect of the invention, there is provided a container comprising: A front wall member of rigid material, having a first face, and first and second side edges. Personalized, variable human-readable indicia formed as an integral part of the front wall member first face. First and second side wall members of rigid material, each having first and second faces. Means defining surface manifestations in each of the first and second side wall member second faces, the surface manifestations for engaging and holding in place the side edges of the front wall member. Top, rear, and bottom walls cooperating with the front and side wall members, to define an open interior volume, the first faces of the front and side wall members facing outwardly from the interior volume, the orientation of the top and bottom walls being determined the orientation of the indicia. And, connector means for connecting the front, side, top, rear, and bottom walls together.

The side walls may be wood, castable metal, or decorative stone, and the maximum dimensions of the front and side walls is about fifteen inches, and the weight of the container (urn) is about 7–16 pounds (depending upon the materials utilized).

According to the second aspect of the present invention, a container is provided comprising: A front wall member of rigid material, having a first face, and first and second side edges. First and second side wall members of rigid material, each having first and second faces. Top, rear, and bottom walls cooperating with the front and side wall members, to define an open interior volume, the first faces of the front and side wall members facing outwardly from the interior volume, the top and rear, and part of the bottom, walls being formed of a single piece of malleable material including a front edge flange which engages the first face of the front wall member to assist in holding the front wall in place, and side edges. Means defining surface manifestations in each of the first and second side wall member second faces, the surface manifestations for engaging and holding in place the side edges of the front wall member and the single piece of malleable material. And, connector means for connecting the front, side, top, rear, and bottom walls together. The bottom wall may comprise a first flange formed by the single piece of malleable material (e.g. jewelry grade metal, such as brass, or aesthetic plastic), and a second flange of malleable material having a lip portion engaging the front wall first face, and a support portion engaging a bottom edge of the front wall member. The second flange cooperates with the surface manifestations and the front edge flange to hold the front wall member in place. The bottom may comprise a removable bottom plate connected by removable fasteners to the first and second flanges.

According to the third aspect of the present invention, a method of displaying ashes of a cremated human is provided. The method comprises the following steps: (a) Forming a container with an interior volume defined by a front wall of material selected from the group consisting of decorative stone, aesthetic synthetic stone, and castable jewelry grade metal and having a front face, side walls, a top wall, a rear wall, a bottom wall, and a removable panel, by fastening the walls together. (b) Forming personalized, variable, human-readable indicia as an integral part of the front wall front face, the indicia including the name of a cremated human. (c) Removing the removable panel of the container to access the interior volume. (d) Inserting the ashes of the cremated human in the interior volume. (e) Replacing the removable panel. And, (f) displaying the container.

It is the primary object of the present invention to provide a container and method that are advantageous for the display of ashes of a cremated pet or human. This and other objects of the invention will become clear from an inspection of the detailed description of the invention, and from the appended claims.

DETAILED DESCRIPTION OF THE DRAWINGS

Figure 1:
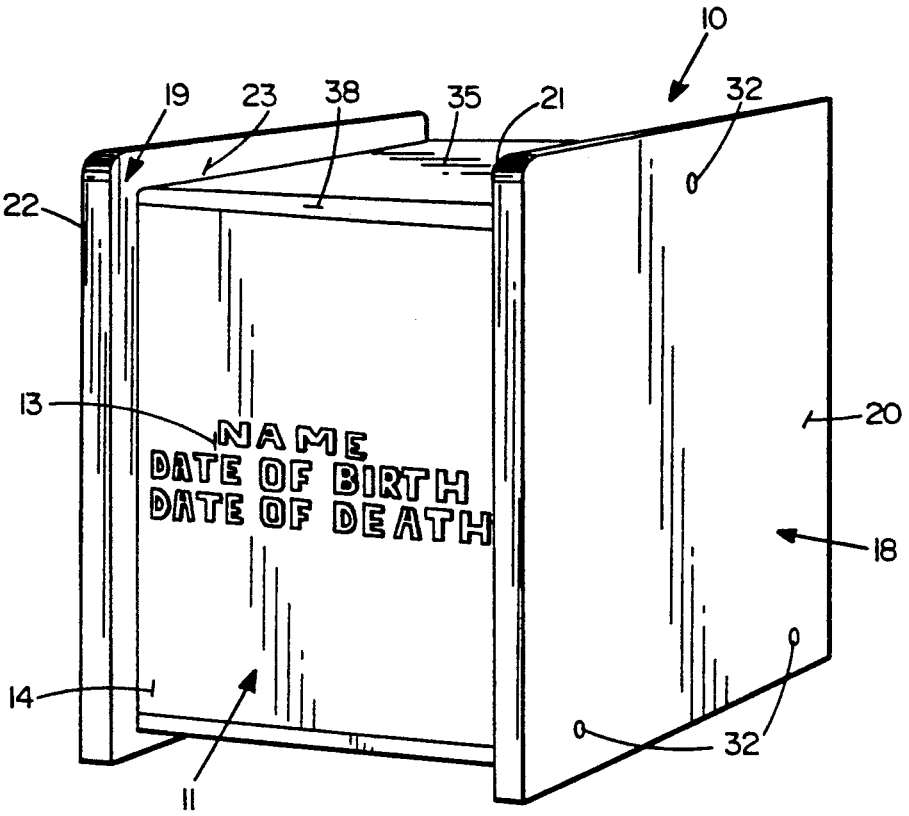
FIG. 1 is a front perspective view of an assembled exemplary personalized face cremation urn (container) according to the present invention.
Figure 2:
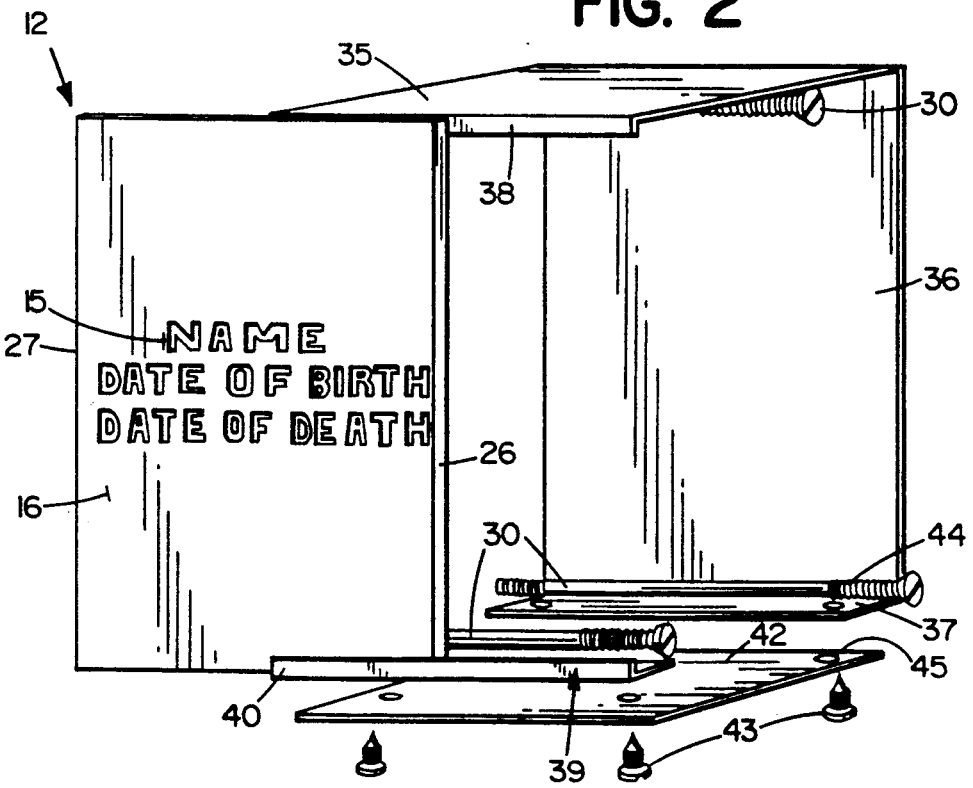
FIG. 2 is an exploded view of the container of FIG. 1 with the sides removed, and with a stone front wall member.
Figure 4:
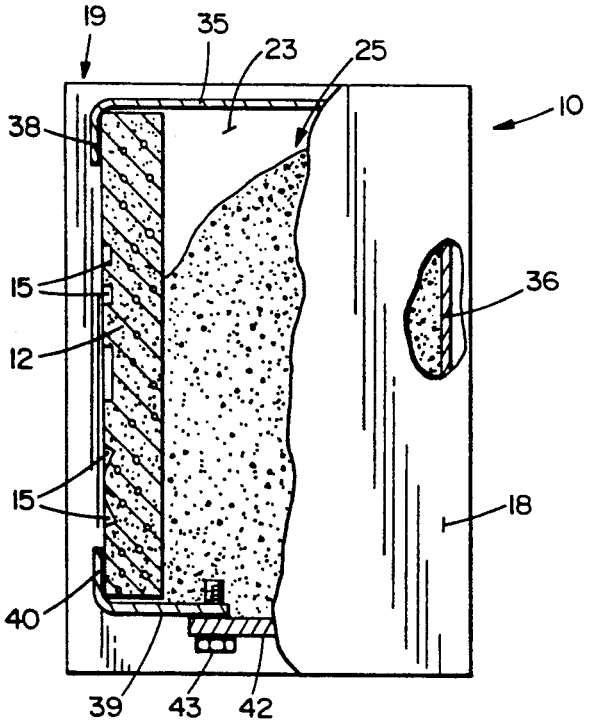
FIG. 4 is a side view, partly in cross section and partly in elevation, of the container of FIG. 2 when assembled.

An exemplary cremation urn (container) according to the present invention is shown generally by reference numeral 10 in FIG. 1. A major component of the container 10 is a rigid, aesthetic, front wall member 11 (FIG. 1) or 12 (FIGS. 2 and 4). The front wall member 11 is of castable jewelry grade metal, such as cast bronze, and has raised indicia 13 on a front face 14 thereof, while the member 12 is of decorative stone (e.g. granite or marble), aesthetic synthetic stone (e.g. synthetic marble), or the like, and has relief indicia 15 formed on the front face 16 thereof, typically by sand blasting. The front wall member 11, 12 typically is roughly ⅜–¾ inch thick, and has a width of about four-eight inches, and a height of about 6–11 inches. The indicia 13, 15 is an integral part of the front wall member 11, 12, which in turn is a structural component of the container 10, and gives an entirely different appearance than a plaque or label which is typically applied to cremation urns.

The indicia 13, 15 is personalized indicia, and typically includes at least the name of the human or pet whose ashes are contained within the container 10. The personalized indicia 13, 15 can also include the date of birth and death, a eulogy, poem, or other personalized information. Of course the indicia 13, 15 is human readable when the container 10 is upright, and its orientation defines the "top" and "bottom" of the container 10.

The personalized indicia 15—as earlier indicated—is preferably formed by sandblasting. Personalized sandblasting masks may be readily obtained from Rayzist Photomask of Vista, Calif. The sandblasting techniques which produce the relief indicia 15 are well known per se.

The container 10 also comprises first and second side wall members 18, 19, respectively, also of rigid material. They each have first and second faces, 20, 21 for the first side wall 18, and 22, 23 for the second side wall 19. As illustrated in the preferred embodiment in the drawings, the dimensions of the side walls 18, 19 are preferably slightly greater than those of the front wall 11, 12, e.g. a width of about 5–9 inches, and a height of about 7–12 inches; and they have roughly the same thickness as the front wall 11, 12 (e.g. about ½ inch). As illustrated the front wall 11, 12 and the side walls 18, 19 are preferably generally planar and generally quadrate (square or rectangular) in construction, although they could have the shapes of other regular or irregular polygons, or could have concave or convex or rounded surfaces.

Figure 3:
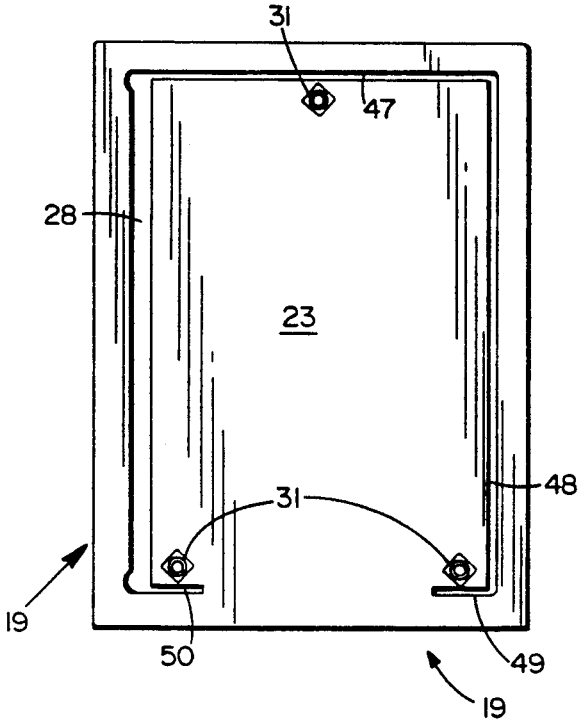
FIG. 3 is an interior side view of one of the side walls of the container of FIG. 1.

The first faces 20, 22 of the side walls 18, 19 face outwardly from the interior volume defined by the container 10 (i.e. occupied by the bag of ashes 25 seen in FIG. 4), while the faces 21, 23 face toward the interior volume. Surface manifestations are provided associated with the faces 21, 23 for engaging and holding in place the side edges 26, 27 or the front wall 12 (or corresponding edges for wall 11). As seen most clearly in FIG. 3, preferably the surface manifestations are in the form of grooves, such as the groove 28 seen in FIG. 3. The groove 28 has only a very slightly greater height and width than the edge 27 of the front wall 12, and receives the edge 27 therein, tightly holding it in place. The inside face 21 of the side wall 18 is the mirror image of the wall 19 illustrated in FIG. 3.

The side walls 18, 19 can be made of a wide variety of materials, including decorative stone or aesthetic synthetic stone, good quality metal, or wood. Preferably they are made of a high quality, decorative hardwood, such as walnut, teak, cherry, ebony, oak, or the like.

The container 10 also comprises connector means for connecting the walls together. The connector means may take the form of a plurality of bolts, such as the three bolts 30 illustrated in FIG. 2. The bolts 30 cooperate with one quarter inch T-nuts or the like 31 that are provided on the inner face 23 of the side wall 19 (see FIG. 3), and the bolts 30 go through openings in the side wall 18 that are in alignment with the T-nuts 31. These openings are shown closed by plugs 32 in FIG. 1 so that they are not readily visible.

The top, rear, and part of the bottom of the container 10 are preferably formed by a single piece of malleable material—shown generally by reference numeral 34 in FIG. 1. The top portion is indicated by reference numeral 35, the rear by 36, and a portion forming the bottom (first flange) 37. The malleable material is preferably a jewelry quality metal, such as brass, stainless steel, or the like, or an aesthetic plastic. A downwardly extending lip 38 is provided on the top portion 35, and engages the front face 16 of the front wall 12, or front face 14 of the front wall 11.

The bottom of the container 10 is also formed by the second flange 39 of malleable material, which preferably has an upturned lip 40 which engages the front face 14 or 16 of the front wall 11 or 12. A final component of the bottom is the removable bottom plate 42, preferably of the same metal as the members 34, 39, which is connected to the flanges 37, 39 by removable fasteners (screws) 43 which pass through alignable openings 44, 45 in the flanges 37, 39 and the bottom plate 42, respectively. The removable nature of the bottom plate 42 makes it easy to access the interior volume of the container 10 to insert or remove the bag of ashes 25 (see FIG. 4), and also to allow easy construction of the container, allowing a worker to insert his/her hand into the interior to align the bolts 30 with the T-nuts 31.

Note that the surface manifestations associated with the side walls 18, 19 also hold the piece 34 in place. The grooves 47, 48, 49 (FIG. 3) cooperate with the side edges of the top 35, rear 36, and first flange 37 portions of the piece 34. A groove 50 also cooperates with second flange 39. These grooves 47–50 are only slightly thicker and longer than the portions of the other components with which they cooperate. When the connector means (bolts 30, nuts 31) are tightened, the walls 18, 19 are pulled together and compress the members 12, 34, and 39, tightly holding all of the container components together.

Figure 5:
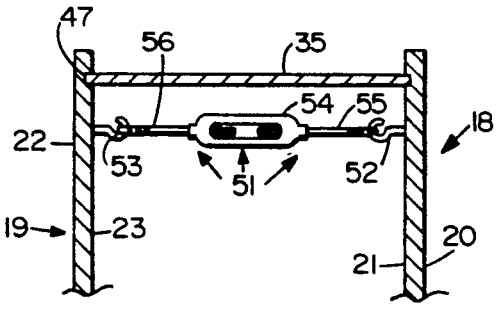
FIG. 5 is a longitudinal cross-sectional view of a part of the container according to the invention showing an alternative form of connector (i.e., hooks and turnbuckles).

An alternative form of connectors, which leaves no marks on the outside of the container 10 that need to be plugged, and which is easy to utilize in constructing the container, is shown in FIG. 5. A single connector means 51 is illustrated in FIG. 5, however, it is to be understood that a plurality of connector means 51 will be utilized (typically three, in the same general positions as the bolts 30 and T-nuts 31).

The connector means 51 comprises hooks 52, 53 which are screwed into the side walls 18, 19, respectively, a conventional turnbuckle 54, and hooks 55, 56 at the ends of the turnbuckle 54 cooperating with the hooks 52, 53, respectively.

Utilizing the apparatus of FIG. 5, when the container walls are assembled, with the hooks 52, 53 already in place, the turnbuckle 54 is adjusted to a position where the hooks 55, 56 thereof are spaced a distance slightly greater than the closest spacing between the hooks 52, 53 that is desired. Then the assembler reaches his/her hand through the opening ultimately covered by the removable bottom panel 42, and places the hooks 55, 56 in loose association with the hooks 52, 53, and then rotates the turnbuckle 54 to cause the walls 18, 19 to be pulled toward each other. The same procedure is repeated for each of the connector means 51 (e.g. three).

In a method of displaying ashes of a cremated human or pet according to the invention, the container 10 is constructed of aesthetic materials, defining an interior volume. Personalized variable, human-readable indicia 13, 15 is formed as an integral part of the front wall 11, 12 front face 14, 16, for example by casting the wall 11 of brass with raised indicia 13, or sand blasting relief indicia 15 in a decorative stone wall 12. The removable bottom panel 42 is removed by unscrewing fasteners 43, to allow one to gain access to the interior of the container 10, the ashes in bag 25 are then inserted into the interior volume, the panel 42 is replaced by tightening the screws 43, and the container 10 is then ready to be displayed.

It will thus be seen that according to the present invention a versatile cremation urn, made of a variety (including within a single urn) of aesthetic construction elements, and having a wall with integral indicia (rather than a plaque or label that is merely added on) has been provided, as well as a method of displaying cremation ashes utilizing such a container. While the invention has been herein shown and described in what is presently conceived to be the most practical and confirmed embodiment thereof, it will be apparent to those of ordinary skill in the art that many modifications may be made thereof within the scope of the invention, which scope is to be accorded the broadest interpretation of the appended claims to cover all equivalent structures and methods.

What is claimed is:

1. A container comprising:

a front wall member of rigid material, having a first face, and first and second side edges;

personalized, variable human-readable indicia formed as an integral part of said front wall member first face;

first and second side wall members of rigid material, each having first and second faces;

means defining surface manifestations in each of said first and second side wall member second faces, said surface manifestations for engaging and holding in place said side edges of said front wall member;

top, rear, and bottom walls cooperating with said front and side wall members, to define an open interior volume, said first faces of said front and side wall members facing outwardly from said interior volume, the orientation of said top and bottom walls being determined by the orientation of said indicia; and connector means for connecting said front, side, top, rear, and bottom walls together.

2. A container as recited in claim 1 wherein said top and rear, and part of said bottom, walls are formed of a single piece of malleable material including a front edge flange which engages the first face of said front wall to cooperate with said side wall surface manifestations to hold said front wall in place.

3. A container as recited in claim 2 wherein said bottom wall comprises a first flange formed by said single piece of malleable material integral with said rear wall, and a second flange of malleable material having a lip portion engaging said front wall first face, and a support portion engaging a bottom edge of said front wall member, said second flange cooperating with said surface manifestations and said front edge flange to hold said front wall member in place.

4. A container as recited in claim 3 wherein said bottom wall further comprises a bottom plate releasably connected by fasteners to said first and second flanges.

5. A container as recited in claim 2 wherein said single piece of malleable material has side edges, and further comprising means defining surface manifestations in said side wall member second faces for receiving and locating, and supporting said side edges of said single piece of malleable material.

6. A container as recited in claim 5 wherein said surface manifestations in said side wall member second faces comprise grooves.

7. A container as recited in claim 6 wherein said side walls are of material selected from the group consisting of wood, castable metal, and decorative stone.

8. A container as recited in claim 1 wherein the maximum dimension of said front and side walls members is about fifteen inches.

9. A container as recited in claim 1 wherein said front wall member is selected from the group consisting of decorative stone and aesthetic synthetic stone, and wherein said personalized variable indicia includes the name of a deceased human or pet recessed in said front wall member first face.

10. A container as recited in claim 1 wherein said connector means comprise a plurality of removable bolts interconnecting said side wall members and compressing said front wall member at said side edges thereof; and further comprising means for masking said bolts so that no portion thereof is visible from the exterior of said container.

11. A container as recited in claim 1 further comprising a removable panel disposed in said bottom wall to allow access to said interior volume, and held in place by removable fasteners accessible from the bottom exterior of said container.

12. A container as recited in claim 1 wherein said side wall members have a height greater than the height of said front wall member, and wherein said surface manifestations are contained completely within the height of said side wall members, so that said front wall member is supported off of a surface on which said side wall members rest, and wherein said front and side wall members are substantially quadrate substantially planar members.

13. A container as recited in claim 1 wherein said connector means comprise a plurality of turnbuckles and a plurality of hooks on the inside of said side wall members, said turnbuckles and hooks operatively engaging each other so that said side walls are drawn together compressing said front wall member at said side edges thereof.

14. A container as recited in claim 2 wherein said malleable material is a jewelry grade metal, said side wall members are wood, and said front wall member is selected from the group consisting of decorative stone, aesthetic synthetic stone, and castable jewelry grade metal.

15. A container comprising:

a front wall member of rigid material, having a first face, and first and second side edges;

first and second side wall members of rigid material, each having first and second faces;

top, rear, and bottom walls cooperating with said front and side wall members, to define an open interior volume, said first faces of said front and side wall members facing outwardly from said interior volume, said top and rear, and part of said bottom, walls being formed of a single piece of malleable material including a front edge flange which engages the first face of said front wall member to assist in holding said front wall in place, and side edges;

means defining surface manifestations in each of said first and second side wall member second faces, said surface manifestations for engaging and holding in place said side edges of said front wall member and said single piece of malleable material; and connector means for connecting said front, side, top, rear, and bottom walls together.

16. A container as recited in claim 15 wherein said bottom wall comprises a first flange formed by said single piece of malleable material integral with said rear wall, and a second flange of malleable material having a lip portion engaging said front wall first face, and a support portion engaging a bottom edge of said front wall member, said second flange cooperating with said surface manifestations and said front edge flange to hold said front wall member in place.

17. A container as recited in claim 15 wherein said single piece of malleable material has side edges, and further comprising means defining surface manifestations in said side wall member second faces for receiving and locating, and supporting said side edges of said single piece of malleable material.

18. A container as recited in claim 15 wherein said connector means comprise a plurality of turnbuckles and a plurality of hooks on the inside of said side wall members, said turnbuckles and hooks operatively engaging each other so that said side walls are drawn together compressing said front wall member at said side edges thereof.

19. A method of displaying ashes of a cremated human or pet, comprising the steps of:

(a) forming a container with an interior volume defined by a front wall of material selected from the group consisting of decorative stone, aesthetic synthetic stone, and castable jewelry grade metal and having a front face, side walls, a top wall, a rear wall, a bottom wall, and a removable panel, by fastening the walls together;

(b) forming personalized, variable, human-readable indicia as an integral part of the front wall front face, the indicia including the name of a cremated human or pet;

(c) removing the removable panel of the container to access the interior volume;

(d) inserting the ashes of the cremated human or pet in the interior volume;

(e) replacing the removable panel; and (f) displaying the container.

20. A method as recited in claim 19 wherein the front wall is decorative stone or aesthetic synthetic stone, and wherein step (b) is practiced by sand blasting relief indicia.

* * * * *